US005735004A

United States Patent [19]

Wooten et al.

[11] Patent Number: 5,735,004

[45] Date of Patent: Apr. 7, 1998

[54] WATER RESISTANT BABY BLANKET ASSEMBLY

[76] Inventors: Duane A. Wooten; Teresa L. Wooten, both of 4636 N. Fuller Pl., Baton Rouge, La. 70816-4231

[21] Appl. No.: 645,427

[22] Filed: May 13, 1996

[51] Int. Cl.[6] ..... A47G 9/00

[52] U.S. Cl. ..... 5/502; 5/484; 5/485; 5/416; 2/69

[58] Field of Search ..... 2/69; 5/416, 484, 5/485, 494, 502, 417

[56] References Cited

U.S. PATENT DOCUMENTS

| | | | |
|---|---|---|---|
| 2,227,751 | 1/1941 | Idelman | 5/494 X |
| 2,441,745 | 5/1948 | Benamy | 2/69 |
| 2,677,834 | 5/1954 | Moynihan | 5/494 X |
| 2,870,464 | 1/1959 | Lalick | 5/502 |
| 4,278,719 | 7/1981 | Sarnecki | 5/484 X |
| 4,579,385 | 4/1986 | Loenig | 297/184 |
| 4,583,779 | 4/1986 | Myers | 297/184 |
| 4,761,032 | 8/1988 | Sanchez et al. | 297/229 |
| 4,917,505 | 4/1990 | Bullard et al. | 383/4 |
| 5,046,204 | 9/1991 | Mohler | 2/69 |
| 5,062,168 | 11/1991 | Kocib | 5/484 X |
| 5,074,616 | 12/1991 | Smith | 297/184 |
| 5,088,139 | 2/1992 | Bloom | 5/420 |
| 5,243,724 | 9/1993 | Barnes | 5/482 |
| 5,414,881 | 5/1995 | Terrazas | 5/417 |
| 5,454,125 | 10/1995 | Rathowski | 5/417 |

*Primary Examiner*—Michael F. Trettel
*Attorney, Agent, or Firm*—David L. Ray

[57] ABSTRACT

A baby blanket assembly for covering and protecting a baby from adverse weather and rain, snow, or water, and for use as a water resistant playmat for a baby, the assembly including a first layer of soft, flexible blanket-type material, and a second layer of water resistant material, the second layer being connected to the first layer. In a preferred embodiment of the invention, a pocket is provided for receipt and protection of the head of the infant from adverse weather conditions. In an additional preferred embodiment of the invention, VELCRO® is connected to the edges of the blanket for connection of the blanket to baby carriers or for connection to another of the strips connected to the blanket assembly.

19 Claims, 4 Drawing Sheets

WATER RESISTANT BABY BLANKET ASSEMBLY

BACKGROUND OF THE INVENTION

1. Field of the Invention

The invention relates to comforters and blankets. In particular, the invention relates to comforters and blankets for babies.

2. Description of the Related Art

It is known in the art that comforters and blankets may be used to cover a baby when carrying and holding the baby in adverse weather conditions such as rain, snow, and cold ambient temperatures. Furthermore, it is known in the art that a baby may be placed on a comforter or blanket on a floor or the ground to prevent the baby from harmful contact with the floor or ground. The floor or ground might be harmfully cold or so hard as to cause injury to the baby.

When conventional blankets or comforters are used to cover babies exposed to rain or snow, the blanket or comforter may become saturated with rain or melted snow and harm the baby. Furthermore, if the floor or ground on which the blanket or comforter is placed is damp, the blanket or comforter may become wet and cause a baby placed thereon to become wet.

The word "blanket" as used herein shall include both blankets and comforters.

Exemplary of the related art are the following U.S. Pat. Nos.: 5,454,125; 5,243,724; 5,088,139; 5,074,616; 4,917,505; 4,761,032; 4,583,779; and 4,579,385.

SUMMARY OF THE INVENTION

In accordance with the present invention there is provided a baby blanket assembly for covering and protecting a baby from adverse weather and rain, snow, or water, the assembly including a first layer of soft, flexible blanket-type material, and a second layer of water resistant material, the second layer being connected to the first layer. In a preferred embodiment of the invention, a pocket is provided in one corner of the blanket assembly for receipt and protection of the head of the infant from adverse weather conditions. In an additional preferred embodiment of the invention, VELCRO® hook and loop fastener is connected to the edges of the blanket for connection of the blanket to baby carriers or for connection to another of the strips connected to the blanket assembly.

The baby blanket assembly of the invention has the advantage of protecting the baby from adverse weather conditions such as precipitation, cold ambient temperatures, and sunlight.

Furthermore, the baby blanket assembly of the invention has the advantage of protecting the baby from damp or wet surfaces upon which the blanket is placed.

The invention has the additional advantage of enabling snug wrapping about the baby for maximum comfort and protection of the baby from adverse weather conditions.

DESCRIPTION OF THE PREFERRED EMBODIMENTS

Figure 1:
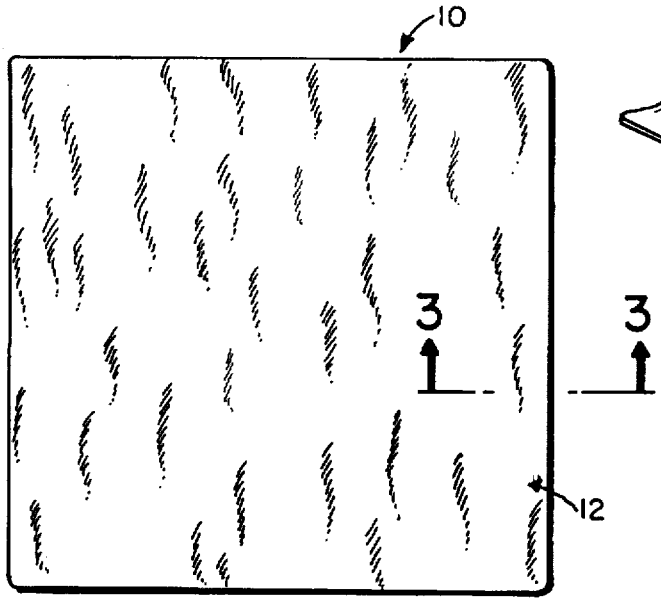
FIG. 1 is a plan view of a first embodiment of the blanket side of the baby blanket assembly of the invention.
Figure 4:
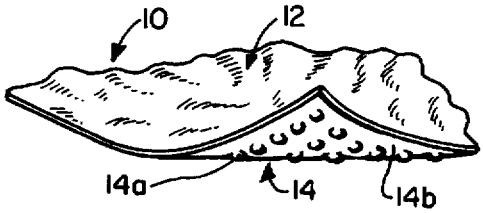
FIG. 4 is a partly cut-away, perspective view of a corner of the first embodiment of the baby blanket assembly of the invention with a portion of the corner of the invention elevated to show the underside of the invention.
Figure 2:
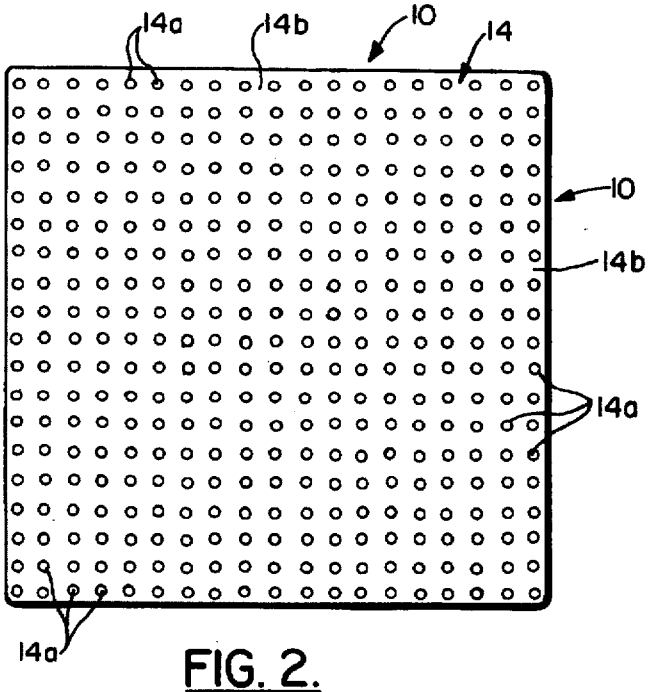
FIG. 2 is a plan view of the water resistant side of the first embodiment of the baby blanket assembly of the invention.
Figure 3:
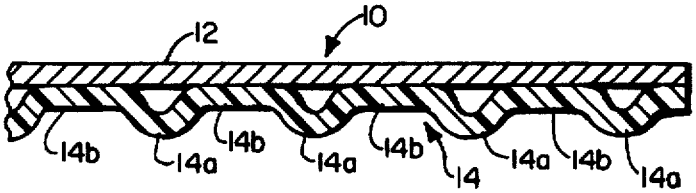
FIG. 3 is a cross-sectional view of the first embodiment of the baby blanket assembly of the invention taken along line 3—3 of FIG. 1.
Figure 6:
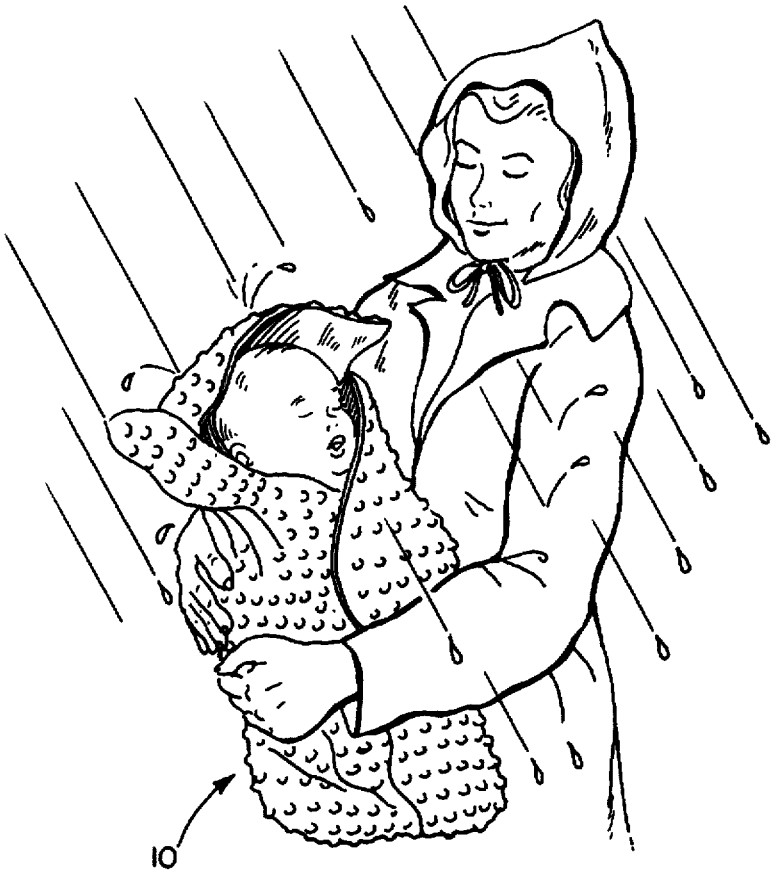
FIG. 6 is a perspective view of an baby wrapped in the first embodiment of the baby blanket assembly of the invention, the baby being held by an adult in a rainstorm.
Figure 7:
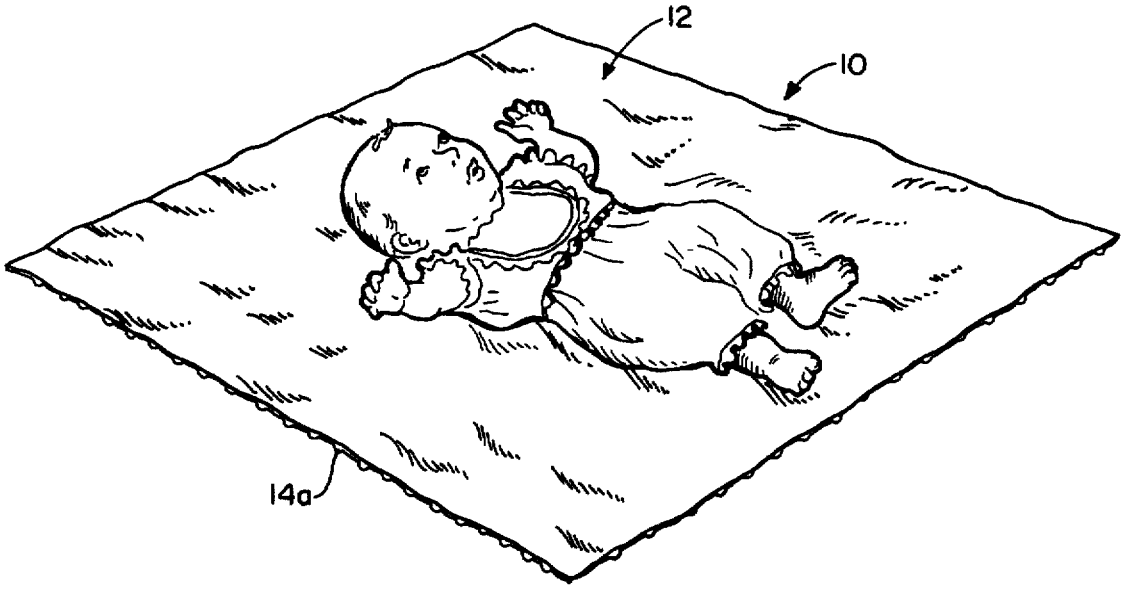
FIG. 7 is a perspective view of the first embodiment of the baby blanket assembly of the present invention with the water resistant side being placed on the floor or ground and a baby lying on the blanket side of the invention.

Referring now to the drawings, in each of the FIGS. 1–4 and 6–7 is shown the baby blanket assembly of the first embodiment of the invention generally indicated by the numeral 10. Baby blanket assembly 10 has a blanket surface or layer 12 and a water resistant or water-proof surface or layer 14. Preferably, blanket assembly 10 is rectangular in shape as shown in FIGS. 1, 2 and 7 to insure a snug, compact fit around the baby. Most preferably, blanket assembly 10 is square in shape as shown in FIGS. 1, 2 and 7 to insure a snug, compact fit around the baby. Furthermore, it is preferred that each edge of the most preferred, square blanket assembly 10 be no longer than three and one-half feet in length to prevent unnecessary bulk and facilitate a snug, compact fit around the baby. However, if desired, blanket assembly 10 may have any desired shape and be made of any desired size.

Blanket layer 12 is constructed from a soft, flexible material which is comforting to a baby. Blanket layer 12 may be a conventional baby blanket made from natural or synthetic fibers. Preferably blanket layer 12 is woven fabric of natural fibers such as cotton. However, blanket layer 12 may be woven from natural fibers such as wool or the like. Furthermore, blanket layer 12 may be made from woven or non-woven synthetic fibers such as polymeric materials.

Water resistant layer 14 may be made from any conventional flexible water resistant or water proof material. Water resistant layer 14 displaces water in rainstorms or snow storms as shown in FIG. 6 and keeps the baby dry and comfortable. Furthermore, water resistant layer 14 keeps the baby dry and comfortable when placed on a surface as shown in FIG. 7 that may be damp.

Such water resistant materials from which water resistant layer 14 is constructed may be non-woven sheets of synthetic materials, such as polymeric materials. Exemplary of such materials are polyvinyl chloride, polyvinyl acrylates, polyethylene, foam rubber, and the like. Furthermore, such water resistant materials may include woven sheets of natural or synthetic fibers, and such woven sheets may be impregnated with water resistant compounds.

Preferably, as shown in FIGS. 2–4 and 6–7, water resistant layer 14 has a plurality of protuberances 14*a* thereon for increasing the coefficient of friction between the water resistant layer 14 and a surface on which the water resistant layer 14 is placed. Protuberances 14*a* extend outward from the flat portion 14*b* of water resistant layer and increase the resistance of baby blanket assembly 10 from sliding on a surface on which the water resistant layer 14 is placed as shown in FIG. 7 and used as a playmat. Furthermore, protuberances 14*a* increase the resistance of baby blanket assembly 10 to sliding in the arms of an adult holding a baby as shown in FIG. 6. Protuberances may have any desired shape which will increase the coefficient of friction between a surface on which the water resistant layer 14 is placed.

Layer 12 may be connected to layer 14 in any manner known in the art. For example, layer 12 may be connected to layer 14 by sewing, gluing, heat sealing, or the like.

Figure 5:
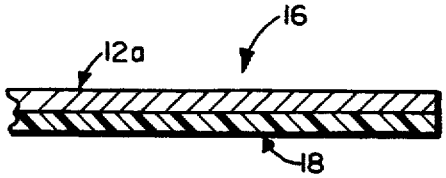
FIG. 5 is a cross-sectional view of a second embodiment of the baby blanket assembly of the invention.

In FIG. 5 is shown the baby blanket assembly of the second embodiment of the invention generally indicated by the numeral 16. Baby blanket assembly 16 has a blanket surface or layer 12*a* and a water resistant or water-proof surface or layer 18 having a smooth outer surface with no protuberances thereon. Blanket assembly 16 has the same shape as blanket assembly 10 shown in FIGS. 1, 2 and 7.

Blanket layer 12*a* is constructed from the same materials as blanket layer 12, and water resistant layer 18 is constructed from the same materials as water resistant layer 14. Blanket layer 12*a* is connected to water resistant layer 18 in the same manner as blanket layer 12 is connected to water resistant layer 14.

In each of the FIGS. 8–12 is shown a third embodiment of the baby blanket assembly of the invention generally indicated by the numeral 20 which is preferably constructed in the shape of a rectangle, or more preferably, in the shape of a square. Shapes other than a square may be utilized for baby blanket assembly 20 if desired, such as a diamond shape, for example.

Baby blanket assembly 20 has a blanket surface or layer 12*b* and a water resistant or water-proof surface or layer 22 having protuberances 22*a* thereon, similar to the protuberances 14*a*, having the have the same function and utility as protuberances 14*a*. Protuberances 22*a* extend outward from the flat portion 22*b* of water resistant layer 22 and increase the resistance of baby blanket assembly 20 to sliding on a surface on which the water resistant layer 22 is placed. Furthermore, protuberances 22*a* increase the resistance of baby blanket assembly 20 to sliding in the arms of an adult holding a baby.

Figure 8:
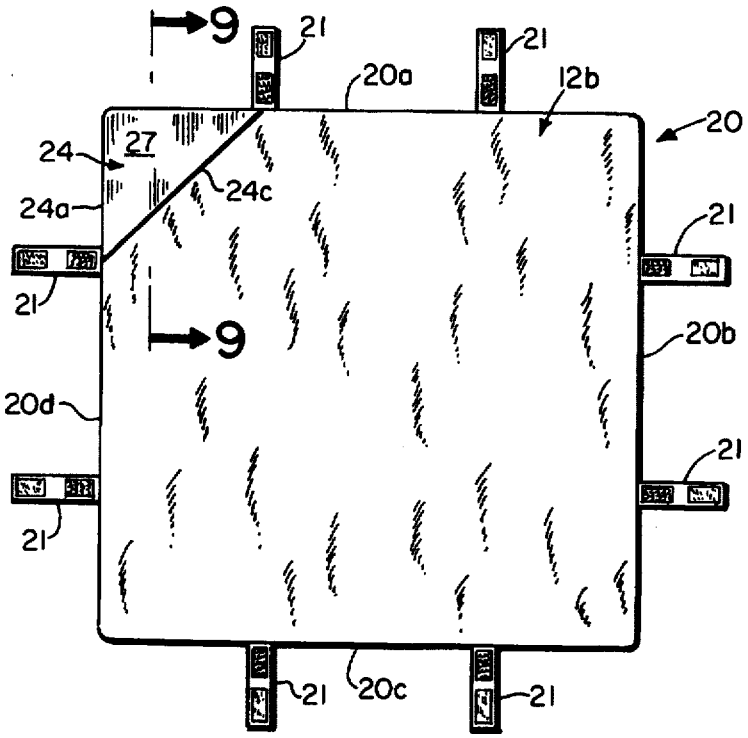
FIG. 8 is a plan view of the blanket side of a third embodiment of the baby blanket assembly of the invention.
Figure 9:
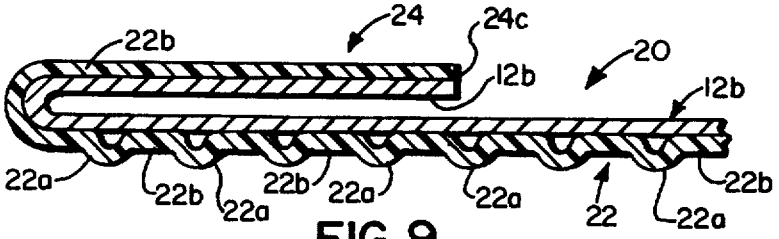
FIG. 9 is a cross-sectional view of the third embodiment of the invention taken along lines 9—9 of FIG. 8.
Figure 10:
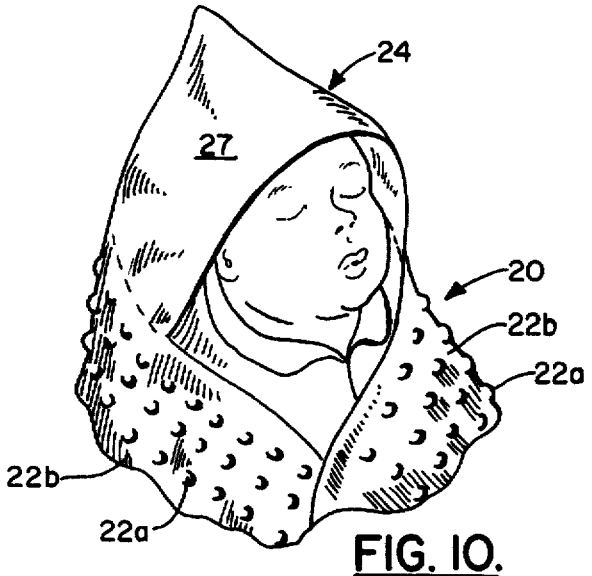
FIG. 10 is a partly cut-away perspective view of a baby wrapped in the third embodiment of the baby blanket assembly of the invention.

Blanket assembly 20 has a pocket generally indicated by the numeral 24 shown in FIGS. 8 and 9 located in one corner of the blanket assembly 20. The pocket 24 fits over the head of a baby as shown in FIG. 10 to prevent rain, snow or other precipitation or sunlight from contacting the face and head of the baby.

Preferably, pocket 24 is generally triangular in shape and has a smooth outer surface 27. Two edges 24*a* and 24*b* of pocket 24 are connected to the corresponding edges of blanket assembly 20 by folding or any other conventional manner. The diagonal edge 24*c* is open and not connected to the corresponding portion of blanket layer 12*b* to facilitate receipt of the head of a baby as shown in FIG. 10.

Furthermore, it is preferred that each edge of the preferred square blanket assembly 20 be no longer than three and one-half feet in length to prevent unnecessary bulk and facilitate a snug, compact fit around the baby. However, if desired, blanket assembly 20 may be made of any desired size.

Figure 11:
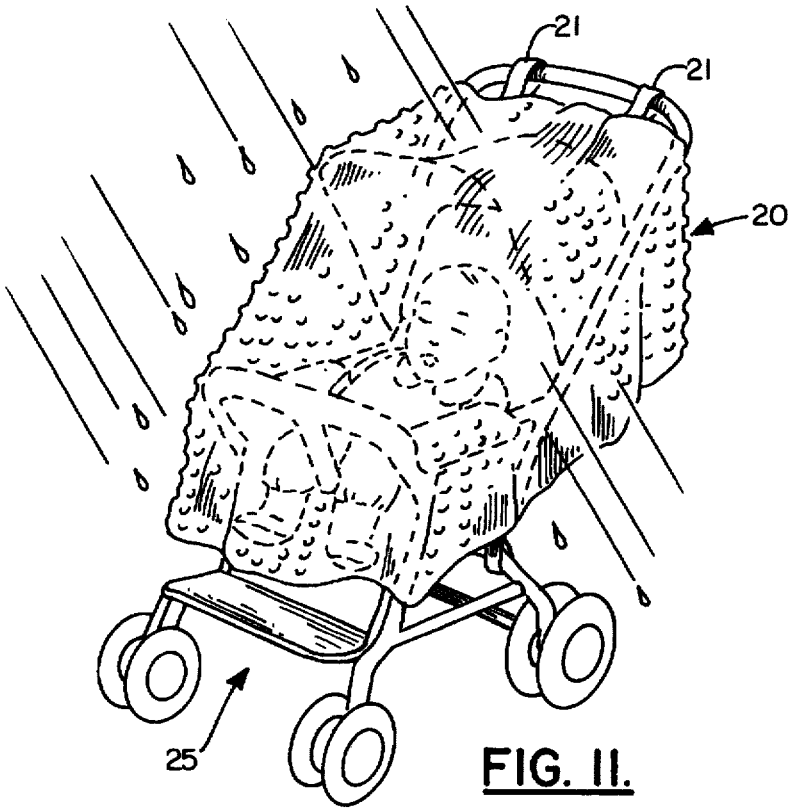
FIG. 11 is a perspective view of the third embodiment of the invention covering a baby in a stroller in a rainstorm.
Figure 12:
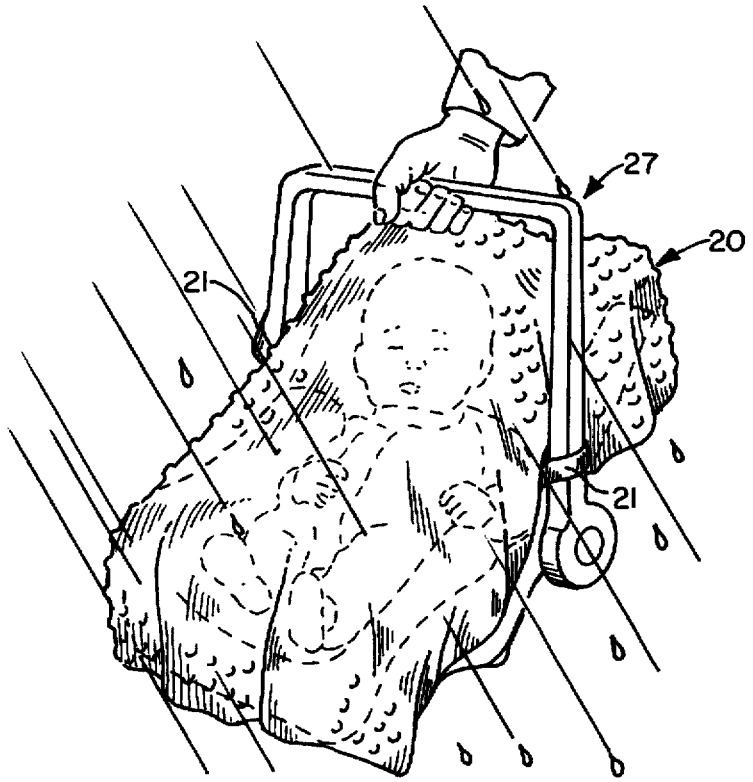
FIG. 12 is a perspective view of the third embodiment of the invention covering a baby in a baby carrier or car seat in a rainstorm.

Blanket assembly 20 preferably has a plurality of connecting strips 21 such as VELCRO® hook and loop fastener strips 21 connected to the edges 20*a*, 20*b*, 20*c* and 20*d* thereof, although strips 21 may be omitted if desired. Preferably, the strips 21 have VELCRO® hook and loop fastener on both sides thereof. Strips 21 enable blanket assembly 20 to be secured to a baby carrier such as the stroller 25 as shown in FIG. 11 or to a baby carrier such as the car seat shown in FIG. 12. Strips 21 may be utilized to secure blanket assembly to any other desired device or to each other. If desired, rather than utilizing VELCRO® hook and loop fastener, strips 21 could have buttons, snaps, or the like for connecting the strips 21 to baby carriers, car seats, or the like. Blanket assembly 20 may be used as a playmat in the same manner as blanket assembly 10 is used in FIG. 7, in addition to being used as a water resistant cover as shown in FIGS. 10, 11, and 12.

Blanket layer 12*b* is constructed from the same materials as blanket layer 12, and water resistant layer 22 is constructed from the same materials as water resistant layer 14. Blanket layer 12*b* is connected to water resistant layer 22 in the same manner as blanket layer 12 is connected to water resistant layer 14.

The baby blanket assembly of the invention can be seen to have the dual purpose of providing a cover for the baby which is water resistant, and furthermore providing a water resistant playmat for the baby.

If desired, each of the embodiments of the invention could be embellished with lace on the edges thereof. Furthermore, logos or other advertising messages could be printed on the outer layer of the baby blanket assemblies of the invention.

Although the preferred embodiments of the invention have been described in detail above, it should be understood that the invention is in no sense limited thereby, and its scope is to be determined by that of the following claims:

What is claimed is:

1. A baby blanket assembly for covering and protecting a baby from adverse weather and rain, snow, or water, and for use as a water resistant playmat for a baby, said assembly comprising:

a. a first layer of soft, flexible blanket-type material, and b. a second layer of water resistant material, said second layer being connected to said first layer, said second layer having a plurality of protuberance means thereon for increasing the coefficient of friction of the outside of said second layer, and c. a plurality of connection means connected to said assembly for connecting said baby blanket assembly to baby carriers or to another of said connection means.

2. The baby blanket assembly of claim 1 wherein said assembly is rectangular in shape.

3. The baby blanket assembly of claim 1 wherein said assembly is square in shape.

4. The baby blanket assembly of claim 3 wherein the length of each edge of said square is equal to, or less than, three and one-half feet in length.

5. The baby blanket assembly of claim 1 wherein said connection means are hook and loop fastener strips.

6. The baby blanket assembly of claim 1 wherein said first layer has a pocket means in one corner thereof for receipt of the head of a baby to protect the head of the baby from adverse weather conditions.

7. The baby blanket assembly of claim 6 wherein said pocket means is generally triangular in shape.

8. The baby blanket assembly of claim 6 wherein said assembly is square in shape.

9. The baby blanket assembly of claim 8 wherein said pocket is located in one corner of said blanket assembly.

10. The baby blanket assembly of claim 9 wherein said pocket means is generally triangular in shape.

11. A baby blanket assembly for covering and protecting a baby from adverse weather and rain, snow, or water, and for use as a water resistant playmat for a baby, said assembly comprising:

a. a first layer of soft, flexible blanket-type material, and b. a second layer of water resistant material, said second layer being connected to said first layer, said second layer having a plurality of protuberance means thereon for increasing the coefficient of friction of the outside of said second layer.

12. The baby blanket assembly of claim 11 wherein said assembly is rectangular in shape.

13. The baby blanket assembly of claim 11 wherein said assembly is square in shape.

14. The baby blanket assembly of claim 13 wherein the length of each edge of said square is equal to, or less than, three and one-half feet in length.

15. The baby blanket assembly of claim 11 wherein said blanket has a plurality of connection means connected thereto for connecting said baby blanket assembly to baby carriers or to another of said connection means.

16. The baby blanket assembly of claim 15 wherein said connection means are hook and loop fastener strips.

17. The baby blanket assembly of claim 11 wherein said first layer has a pocket means in one corner thereof for receipt of the head of a baby to protect the head of the baby from adverse weather conditions.

18. The baby blanket assembly of claim 17 wherein said assembly is square in shape.

19. The baby blanket assembly of claim 18 wherein said pocket means is generally triangular in shape.

* * * * *